US007972154B2

(12) United States Patent
Pech et al.

(10) Patent No.: US 7,972,154 B2
(45) Date of Patent: Jul. 5, 2011

(54) ROTATABLE FEED

(75) Inventors: Udo Pech, Edelsfeld (DE); Martin Eichner, Simmelsdorf (DE); Rainer Maussner, Ottensoos (DE)

(73) Assignee: ABL Sursum Bayerische Elektrozubehor GmbH & Co. KG, Lauf (DE)

( * ) Notice: Subject to any disclaimer, the term of this patent is extended or adjusted under 35 U.S.C. 154(b) by 0 days.

(21) Appl. No.: 12/293,870

(22) PCT Filed: Nov. 4, 2006

(86) PCT No.: PCT/EP2006/010587

§ 371 (c)(1),
(2), (4) Date: Oct. 21, 2008

(87) PCT Pub. No.: WO2007/131543

PCT Pub. Date: Nov. 22, 2007

(65) Prior Publication Data

US 2009/0130892 A1 May 21, 2009

(30) Foreign Application Priority Data

May 11, 2006 (DE) ..... 10 2006 021 931

(51) Int. Cl.
*H01R 29/00* (2006.01)

(52) U.S. Cl. ..... 439/173; 439/564

(58) Field of Classification Search ..... 439/167, 439/173, 271, 322, 534, 564, 954
See application file for complete search history.

(56) References Cited

U.S. PATENT DOCUMENTS

| | | | | | |
|---|---|---|---|---|---|
| 4,245,875 | A * | 1/1981 | Shaffer et al. | 439/144 |
| 4,553,000 | A * | 11/1985 | Appleton | 200/50.29 |
| 4,770,644 | A * | 9/1988 | Feder | 439/166 |
| 4,772,215 | A * | 9/1988 | Falk | 439/188 |
| 5,316,499 | A | 5/1994 | Scannelli | |
| 5,571,023 | A * | 11/1996 | Anthony | 439/142 |
| 5,641,310 | A * | 6/1997 | Tiberio, Jr. | 439/680 |
| 5,980,278 | A * | 11/1999 | Winkler | 439/142 |
| 6,287,136 | B1 * | 9/2001 | Deutsch | 439/337 |
| 6,626,699 | B1 * | 9/2003 | Epe et al. | 439/527 |
| 7,201,590 | B1 * | 4/2007 | Chen | 439/142 |
| 7,575,450 | B2 * | 8/2009 | Williams et al. | 439/144 |
| 2003/0148659 | A1 * | 8/2003 | Walker et al. | 439/537 |

FOREIGN PATENT DOCUMENTS

| | | | |
|---|---|---|---|
| EP | 0893852 | B1 | 1/1999 |
| EP | 1465293 | B1 | 9/2007 |

* cited by examiner

*Primary Examiner* — Thanh-Tam T Le
(74) *Attorney, Agent, or Firm* — Workman Nydegger

(57) ABSTRACT

Implementations of the invention relate generally to an electrical feed, in particular a CEE feed, for the external supply of electrical power to the power supply system of a mobile load, in particular a mobile home or a recreational vehicle or a boat. This feed can include a) a flange for attaching the feed to and/or in a wall of the mobile load, and b) at least one feed connector for making electrical contact with a coupling, in particular a CEE coupling. Implementations of the invention can make provision for the feed connector to be arranged in the flange in a rotatable manner.

20 Claims, 6 Drawing Sheets

ROTATABLE FEED

BACKGROUND OF THE INVENTION

1. Field of the invention

The invention relates to an electrical feed, in particular a CEE feed, for the external supply of electrical power to the power supply system of a mobile load, in particular a motor home (caravan) or a recreational vehicle or a boat. Electrical feeds of this type comprise a flange for attaching the feed to and/or in a wall of the mobile load, and at least one feed connector for making electrical contact with a coupling, in particular a CEE coupling. CEE plug connections are also known as shrouded plug connections.

2. Background and Relevant art

In known feeds, the feed connector is always firmly connected to the flange. The collar of the contact elements, which is provided on the feed connector, and possibly also further components of the feed connector are often integrally formed with the flange.

Feeds of this type are used to connect the internal power supply system of a mobile load to the public electricity network by means of a connection or adapter cable which is connected to an outlet or a pick-up station.

Circular plug apparatuses, in particular CEE plug apparatuses, are usually provided for this purpose. Circular plug apparatuses according to VDE 0623 of the type according to standard EN 60309-2 or IEC 60309-2 are preferably used at campsites and moorings. The motor homes, recreational vehicles and boats are accordingly equipped with feeds which correspond to these plug apparatuses. This also applies to vehicles and motor homes which are designed for travelling shows.

The conventional connection or adapter cable which complies with standards and connects the feed to the outlet or pick-up station has a coupling at the feed end, and an inner bayonet fitting part is formed on said coupling, by means of which inner bayonet fitting part the coupling forms a bayonet fitting with an outer bayonet fitting part which is provided on the feed, the purpose of said bayonet fitting being to ensure a tight connection between the feed and the cable. This outer bayonet fitting part is formed on a dedicated ring element which surrounds the feed connector loosely and therefore, inter alia, also such that it can be rotated in any desired manner as an autonomous body. The feed connector itself has to protrude from the flange at least to such an extent that the coupling can be completely plugged onto said feed connector. The ring element with the outer bayonet fitting part therefore cannot be arranged in this plug region of the feed connector, which region is required for the coupling, but instead still has to be arranged around the feed connector behind the plug region, that is to say in a region which is closer to the flange, with sufficient play still being provided in order to permit the required rotary movement of the ring element for closing the bayonet fitting with the coupling.

One disadvantage of these known electrical feeds is therefore that the feed connector protrudes to a great extent with respect to the flange and therefore with respect to a wall of the mobile load on account of the required plug region for connection to a coupling and on account of the bayonet fitting ring element which is to be provided. In many cases, this is not only visually undesirable but the protruding position also involves a high risk of the feed being damaged, inter alia when the mobile load is moving. For example, motor homes and recreational vehicles on campsites generally have to be lined up in narrow parking spaces. This risk can only be reduced as a result of corresponding structural measures being taken on the mobile load, but these require additional manufacturing outlay and/or impair the overall visual impression.

BRIEF SUMMARY OF THE INVENTION

The object of the invention is to specify a novel electrical feed, in particular a feed in which the abovementioned disadvantages are eliminated or at least reduced and in which, in particular, the feed connector protrudes with respect to the flange and therefore with respect to the wall of the mobile load, at least to a lesser degree than with the above-described, known feeds.

In terms of the electrical plug connector, this object is achieved by the features of patent claim 1. Advantageous developments are specified in the claims which are dependent on claim 1.

According to claim 1, provision is made in the electrical feed according to the invention for the feed connector to be arranged in the flange in a rotatable manner.

The advantages of the invention are, in particular, that the ability of the feed connector to rotate relative to the flange, which in the installed state is firmly attached to a wall of a mobile load, in principle also allows a coupling which is plugged onto the feed connector to rotate relative to the flange and therefore also relative to the wall. It is therefore no longer necessary to provide an independent ring element which is attached such that it can rotate about the feed connector and has an outer bayonet fitting element. Instead, by virtue of the invention, the coupling itself can now also execute the rotary movement which is required to completely close the bayonet fitting, with the inner bayonet fitting part interacting with an outer bayonet fitting part which is arranged in a fixed manner, in particular such that it cannot rotate with respect to the flange, and is preferably provided or formed on the flange itself.

Since a ring element with an outer bayonet fitting part is therefore no longer required in front of the flange, the feed connector can be substantially shorter and the length required to completely plug on the coupling can even run entirely or at least partly within the flange. The invention therefore provides an electrical feed in which the feed connector protrudes to a considerably lesser degree with respect to the flange and therefore with respect to the wall of the mobile load. This reduces the risk of the feed being damaged and allows pleasing visual designs of the mobile loads, these designs not being possible with conventional feeds on account of the large protrusion of the feed connector.

According to one development, provision is made for the feed connector to be arranged and/or fitted in and/or at a leadthrough of the flange in a rotatable manner. This leadthrough expediently has, at least in sections, the shape of a cylinder, and the feed connector can be rotated about the center axis of this cylinder, that is to say the center axis simultaneously forms the axis of rotation of the feed connector. In order to ensure the feed connector rotates in a stable manner in the flange, the feed connector should have, at least in a region which is associated with the leadthrough of the flange, an external shape which corresponds to the leadthrough, in particular the shape of a cylinder jacket. The "cylinder" of the feed connector is then arranged in the "cylinder" of the leadthrough, and the center axes of the two cylinders coincide.

According to one preferred and advantageous embodiment, the axial mobility of the feed connector relative to the flange (that is to say the mobility parallel to the axis of rotation of the feed connector) is limited by at least one front guide face which is provided on the feed connector and by at least one rear guide face which is opposite the front guide face and is likewise provided on the feed connector, with the front guide face and the rear guide face being formed in such a way that they enclose the flange, at least in the edge region around the leadthrough, between them. The guide faces should preferably be arranged and formed in such a way that the axial mobility of the feed connector relative to the flange is completely or at least largely suppressed by the front guide face and the rear guide face.

According to one design variant of the feed, the feed connector comprises a contact carrier, in which contact elements are arranged, and a hood. The hood, also called pot or covering, forms a housing around the contact-making regions of the feed connector which are arranged on the wall-end side of the flange (the side facing a wall of the mobile load in the mounted state) and in which the contact elements are connected to the respective connection lines. The contact carrier and the hood are connected to one another by fastening means, for example screws. The abovementioned front guide face is expediently provided or formed on the contact carrier, and the rear guide face is provided or formed on the hood.

This variant has the advantage that the feed can be produced in a simple manner. The contact carrier is led to the flange from the front and inserted through the leadthrough. After the connection lines make contact with the contact elements, the hood is led to the flange from the rear (wall-end side of the flange in the mounted state) and in the process surrounds the wall-end part of the contact carrier. Finally, the contact carrier and the hood are screwed to one another and form the guide faces which enclose the edge of the leadthrough in the flange. When the feed connector rotates relative to the flange, the contact carrier and the hood rotate together, as one unit, about a common axis of rotation.

At least one seal is preferably arranged between the flange and the feed connector. This seal ensures that liquids from the outside cannot pass through the leadthrough in the flange to the wall-end side of the flange. This seal or these seals is/are arranged between the front guide face and the flange and/or between the rear guide face and the flange. As an alternative or in addition, this seal or these seals can also be arranged between a region of the feed connector which is associated with the leadthrough of the flange and the edge of the leadthrough of the flange.

One expedient design variant of the feed makes provision for the rotary movement of the feed connector relative to the flange to be limited. Stop elements, for example, can be provided or formed on the flange and the feed connector in order to limit the rotary movement. The rotary movement is preferably limited to a maximum rotation angle of between 30° and 270°, in particular of between 160° and 180°, preferably of approximately 172°. Limiting the rotary movement has the advantage that the connection lines and the contact-making means between the connection lines and the contact elements in the feed connector cannot be highly loaded and possibly damaged by excessive rotation of the feed connector. In the case of the maximum rotatability provided, the lines are nowhere near twisted up beyond their load limit, and, with the limited rotary movements provided, no excessive tensile loads which could result in the contact-making means being accidentally disconnected are applied to the contact-making means.

A further particularly preferred development of the electrical feed according to the invention makes provision for the flange to form an outer bayonet fitting part which corresponds to an inner bayonet fitting part, which is formed on a coupling with which contact is to be made, in such a way that the outer bayonet fitting part and the inner bayonet fitting part form a bayonet fitting which allows the coupling to be attached to the electrical feed such that it is secured against being accidentally withdrawn. In this respect, in order to form the outer bayonet fitting part, at least one, preferably two, projections are expediently provided or formed on the flange, said projections being arranged in such a way that they pass through corresponding recesses in a protruding portion of the coupling when the contact elements of the feed connector are inserted into the corresponding contact elements of the coupling, and pass behind the protruding portion of the inner bayonet fitting part on the coupling given a subsequent common rotary movement of the coupling and the feed connector, and in this position prevent the coupling from being drawn back. Preference is given to the situation in which the projections of the outer bayonet fitting part of the flange and the contact elements of the feed connector are arranged in such a way that the coupling can be completely plugged onto the electrical feed only in one of the two stop positions of the feed connector relative to the flange, but not in any other rotary positions. This one possible position should correspond to the position of the feed which the users of conventional feeds are familiar with and therefore allow the coupling to be connected to the feed in a simple and reliable manner without first having to search for a suitable rotary position of the feed connector for this purpose. It is also advantageous if the coupling can be removed from the feed connector again only in this one rotary position (stop position), that is to say, after the coupling is removed, the feed connector is automatically moved to the stop position which is required to plug on the coupling.

In terms of the inner and the outer bayonet fitting parts, the invention naturally also comprises variants in which the inner bayonet fitting part is formed on the coupling and the outer bayonet fitting part is formed on the flange.

According to one expedient development of the feed, a pivotable cover is attached to the flange by means of a hinge, with which cover the leadthrough in the flange, including the feed connector which is arranged therein, can be closed, in particular tightly closed by means of a seal.

BRIEF DESCRIPTION OF THE DRAWINGS

The invention will also be explained in greater detail below in terms of further features and advantages using the description of exemplary embodiments and with reference to the attached drawings, in which.

Mutually corresponding parts are provided with the same reference symbols in FIG. 1 to FIG. 6.

DETAILED DESCRIPTION OF THE PREFERRED EMBODIMENTS

FIG. 1 to FIG. 6 show various views of one exemplary embodiment of an electrical feed 10 according to the invention, which electrical feed is a CEE feed.

Figure 1:
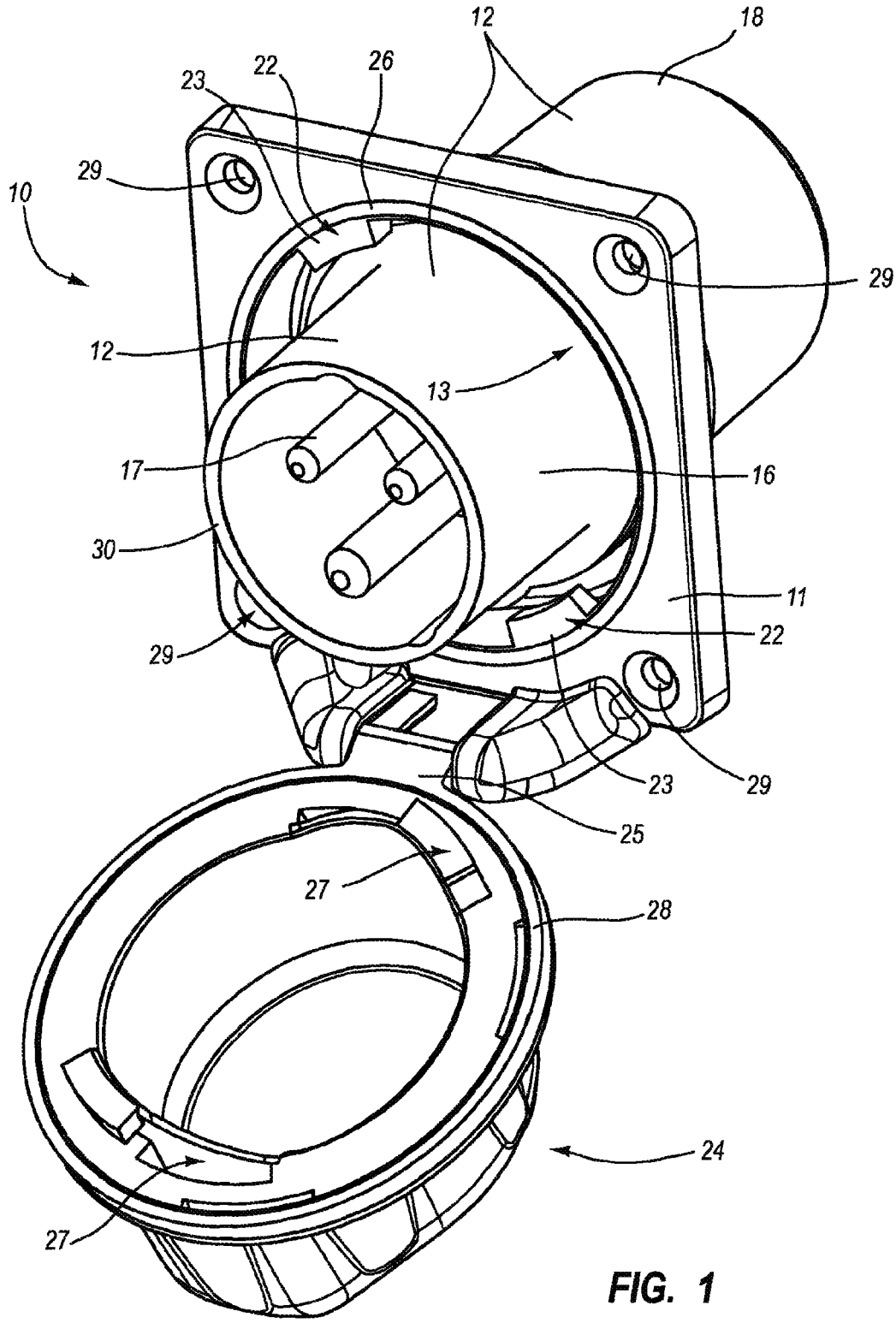
FIG. 1 shows a three-dimensional illustration of one exemplary embodiment of an electrical feed according to the invention.
Figure 5:
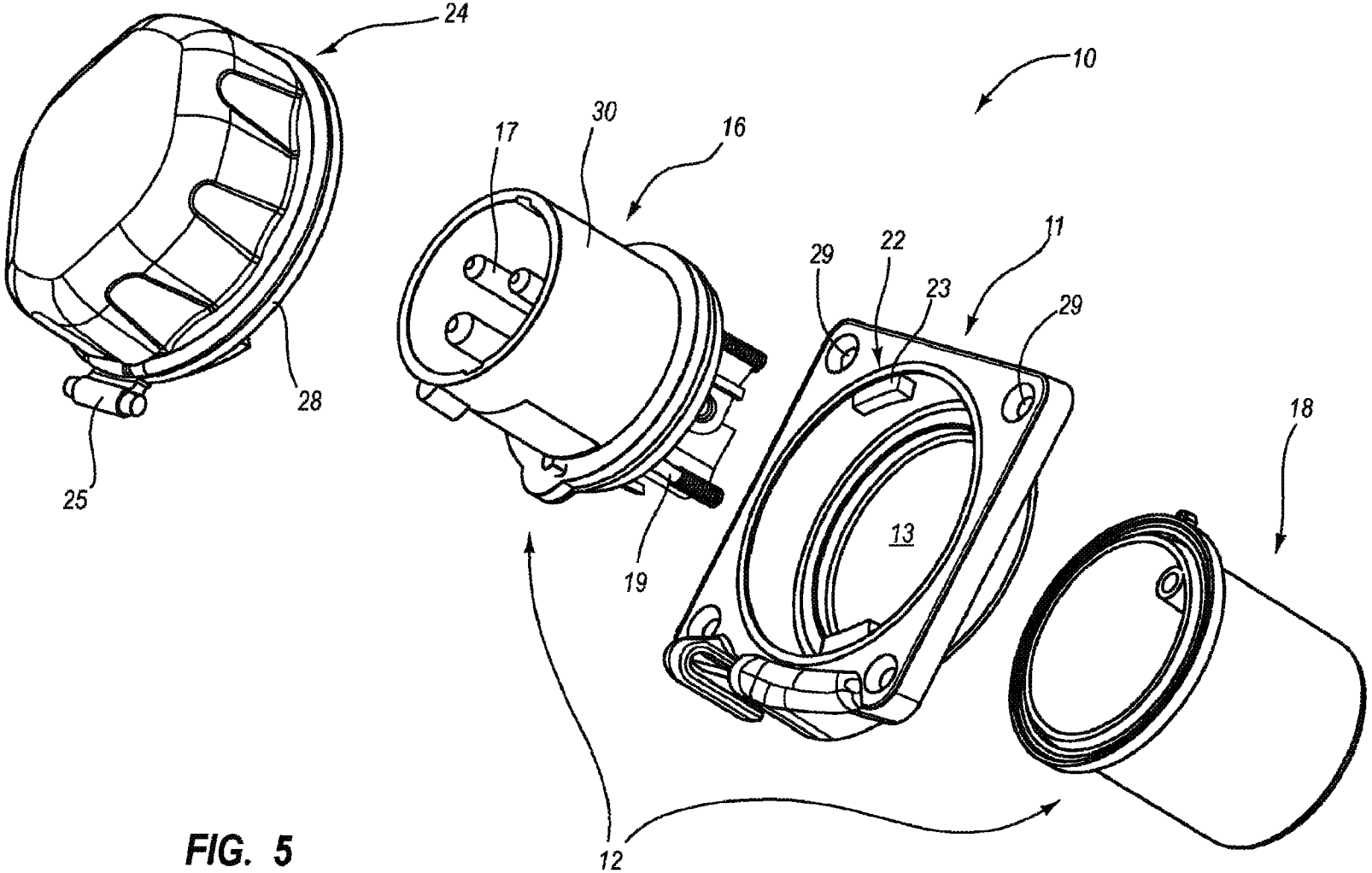
FIG. 5 shows an exploded three-dimensional illustration of the feed according to FIG. 1.
Figure 6:
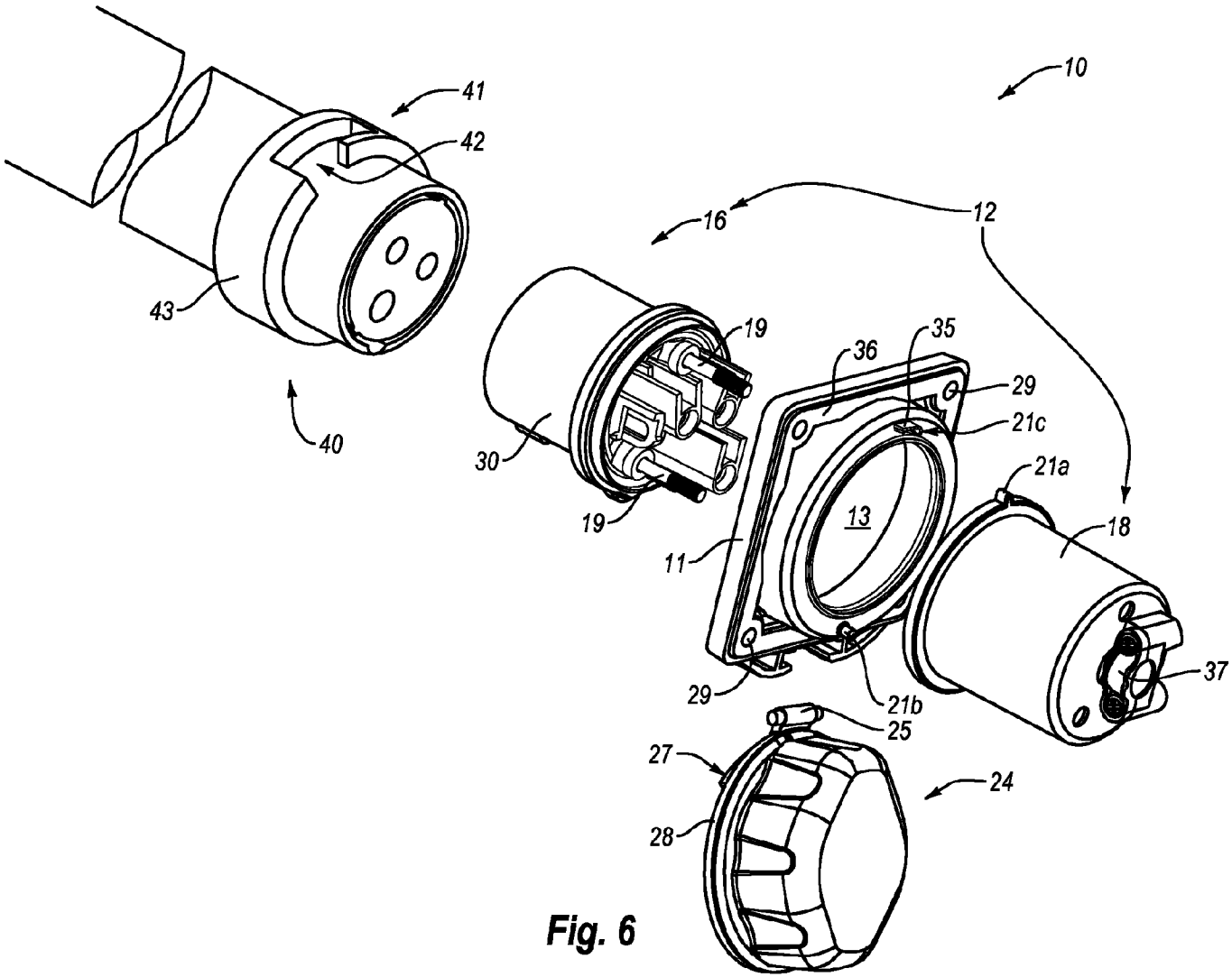
FIG. 6 shows a further exploded three-dimensional illustration of the feed according to FIG. 1.

The three-dimensional illustration in FIG. 1 gives an overview of the entire feed 10. The exploded drawings in FIG. 5 and FIG. 6 show the composition of the feeds 10 made up of the individual components. The Figures show the flange 11 which has four leadthroughs 29 for screws in order for it to be fitted to the outer wall of a mobile load, for example a motor home, recreational vehicle or boat. In order to seal the rear side of the flange (wall side of the flange 11 in the fitted state), a flange seal 36 is provided which, when the flange 11 is fixed to a wall, is pressed against said wall in a sealing manner.

A feed connector 12 is passed through a leadthrough 13 in the flange 11. This feed connector 12 comprises a contact carrier 16, in which contact elements 17, in this case contact pins 17, are arranged, and a hood 18 which can also be called a housing or covering or pot and covers the feed connector 12 at the rear side of the flange 11, with the result that, in particular, the contact-making means, which is arranged there, between the contact elements 17 and a respective connection line (not illustrated) is protected. The contact pins 17 protrude in the region in front of the flange 11 in order to make contact with a coupling 40 (see FIG. 5), in particular a CEE coupling. The contact pins 17 are surrounded by a collar 30 which is likewise provided on the contact carrier 16 of the feed connector. In the illustrated example, the feed is a feed 10 with three contact pins 17, of which one usually makes contact with the earthed protective conductor in the plugged-on coupling 40 and the two others make contact with the phase and neutral conductors.

The feed connector 12 is fitted in the flange 11 in a rotatable manner. This can be seen, in particular, in the cross-sectional illustrations in FIG. 2, FIG. 3 and FIG. 4 which show, in detail, how the rotatable arrangement of the feed connector 12 is implemented in the flange 11. In this case, FIG. 3 shows an enlarged illustration of the region denoted X in FIG. 2, FIG. 4 shows an exploded illustration of the cross section according to FIG. 2, that is to say the important components of the feed 10 are illustrated in a manner in which they are separated from one another.

It can be seen that the feed connector rotates about an axis of rotation A which passes through the center of the leadthrough 13 in the flange 11 and therefore represents a center axis of the leadthrough 13. In a subregion 31, the leadthrough 13 is formed in the shape of a cylinder, that is to say the flange 11 surrounds the leadthrough 13 in the manner of a cylinder jacket in this region. The axis of the associated cylinder is the axis of rotation A.

The feed connector 12, to be precise the contact carrier 16 of the feed connector 12, is likewise formed in the shape of a cylinder jacket at least in a region 32 which corresponds to this subregion 31 of the leadthrough 13, with the axis of the associated cylinder likewise being the axis of rotation A and the cylinder radius being only slightly smaller than the radius of the cylinder which can be associated with the leadthrough 13. The difference between the two radii is selected such that it is possible for the feed connector 12 to execute a rotary movement about the axis of rotation A in the leadthrough 13 of the flange 11 in a problem-free manner substantially without tilting.

Figure 2:
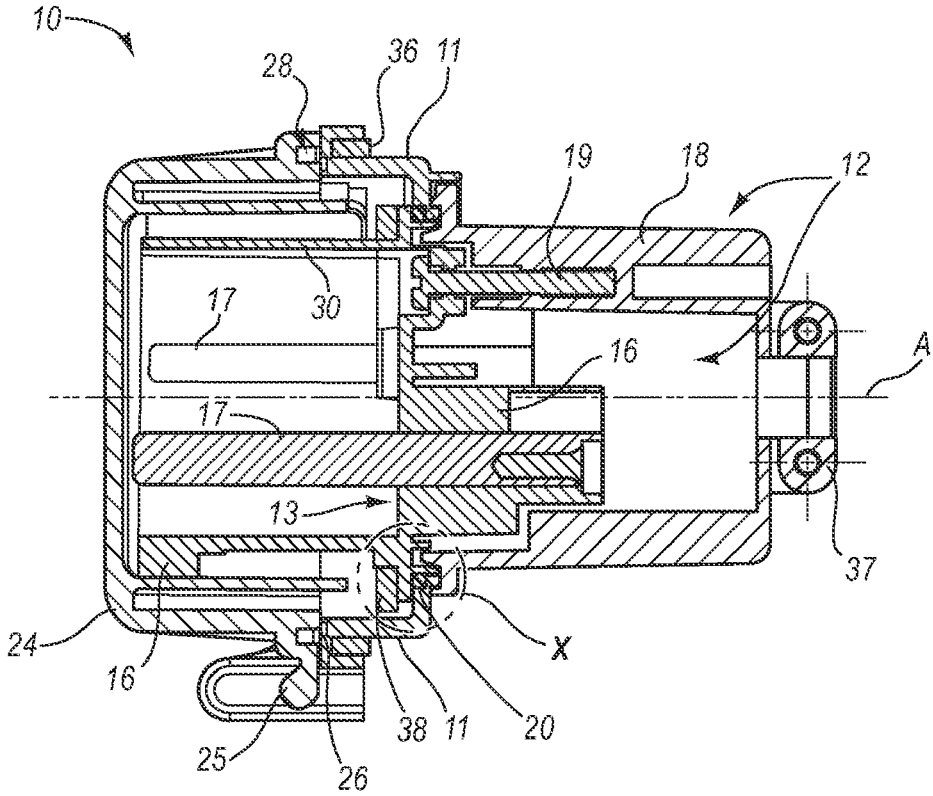
FIG. 2 shows a cross-sectional illustration of the feed according to FIG. 1.
Figure 3:
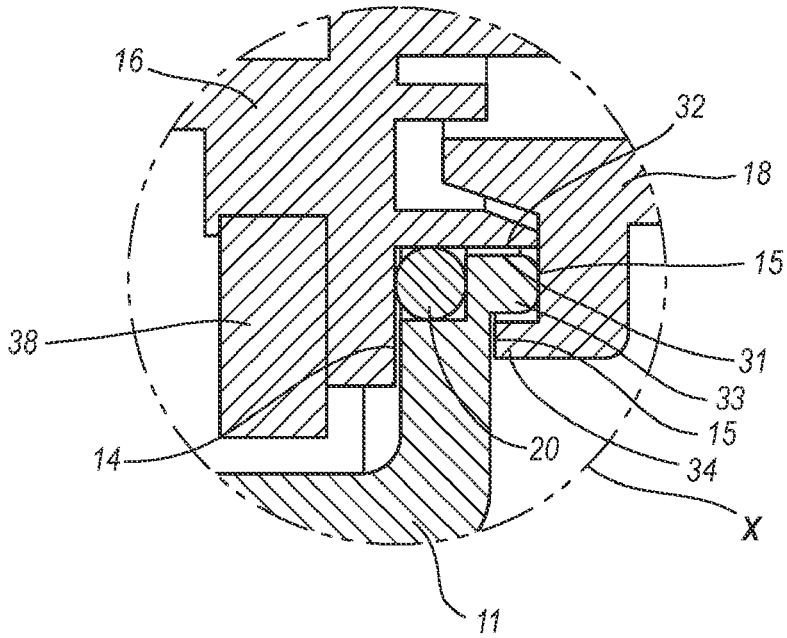
FIG. 3 shows an enlarged detail from FIG. 2.
Figure 4:
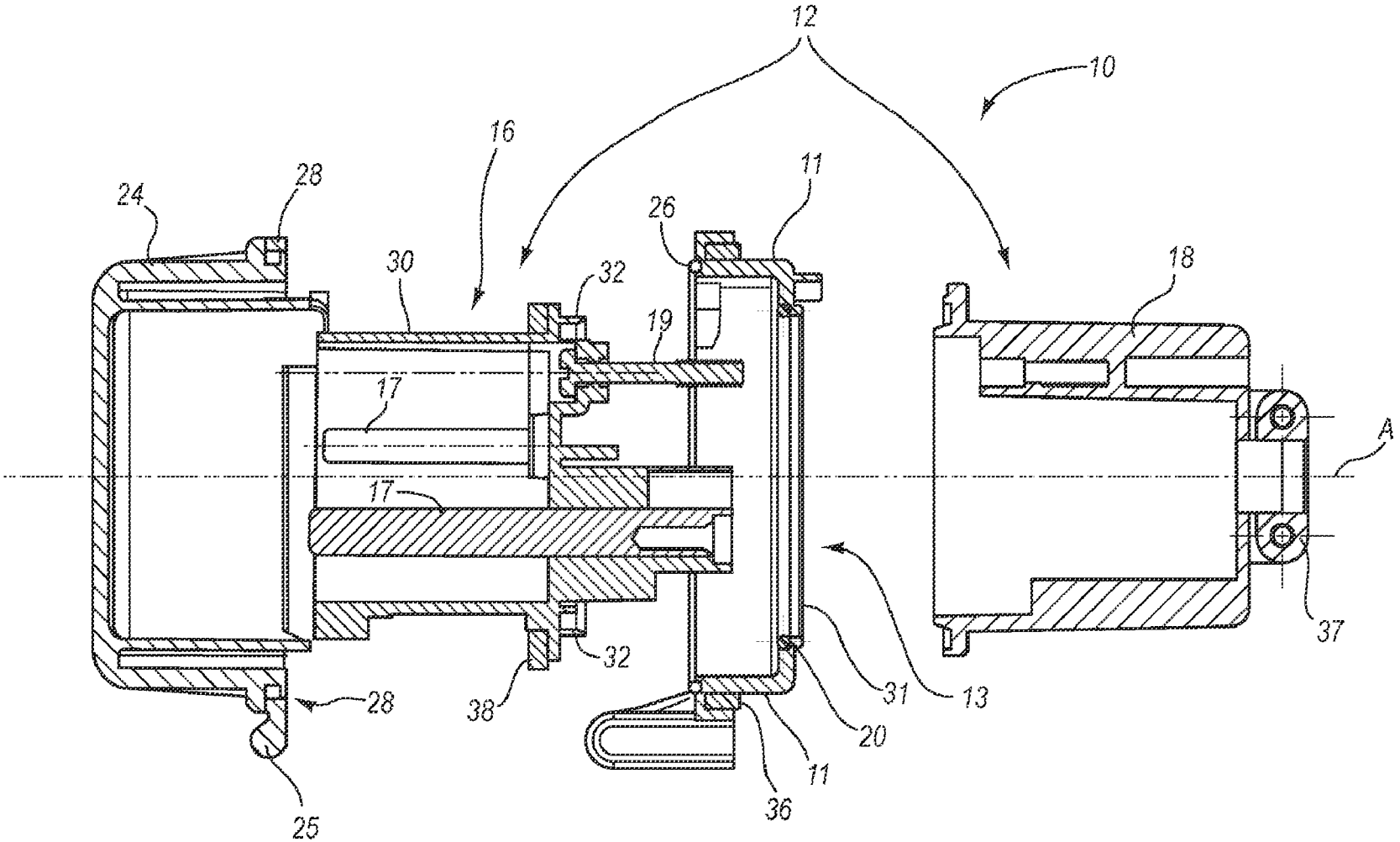
FIG. 4 shows an exploded illustration of the cross-sectional illustration according to FIG. 2.

FIG. 3 in particular, but also FIG. 2 and FIG. 4, shows that the axial mobility of the feed connector 12 relative to the flange 11, that is to say the mobility parallel to the axis of rotation A, is limited

- by a front guide face 14 which is provided on the contact carrier 16 of the feed connector 12; and
- by two rear guide faces 15 which are provided on the hood 18 of the feed connector 12 and are situated opposite the front guide face 14.

The front guide face 14 and the rear guide faces 15 are formed in such a way that they enclose the flange 11, at least in the edge region around the leadthrough 13, between them. In this case, the flange diameter in this region and the distance between the enclosing mutually opposite guide faces 14, 15 is selected in such a way that axial movement of the feed connector 12 relative to the flange 11 is entirely or at least largely prevented but the rotary movement of the feed connector 12 is not impaired. FIG. 3 also shows that a protruding portion 33 is formed on the flange 11, this protruding portion being surrounded by a protruding portion 34 of the hood 18 in its radially outer region, as a result of which particularly dimensionally stable and tilt-free rotation of the feed connector 12 about the axis of rotation A is ensured in the flange 11.

FIG. 2 and FIG. 4 to FIG. 6 show that the contact carrier 16 and the hood 18 of the feed connector 12 are connected to one another by fastening means 19, to be precise by screws 19. By being screwed together, the contact carrier 16 and the hood 18 therefore form the main body of the feed connector 12. After the screws 19 are tightened, the front guide face 14 (formed on the contact carrier 16) and the rear guide faces 15 (formed on the hood 18) enclose the flange 11 between them at the edge of the leadthrough 13. In order to seal off the interior space enclosed by the contact carrier 16 and the hood 18, a ring-like seal (not illustrated) can be provided between the contact carrier 16 and the hood 18.

FIG. 3 in particular shows that a seal 20, an O-ring, is arranged between the flange 11 and the feed connector 12. The seal 20 surrounds the feed connector 12 in the form of a ring; it is arranged between the front guide face 14 and the flange 11 and also between the cylinder jacket-like subregion 32 of the contact carrier 16 or feed connector 12 and the flange 11 in the region of the leadthrough 13. The task of the seal 20 is to seal off the rear-facing side of the flange 11, that is to say the wall-end side of the flange 11 in the mounted state, from the opposite front side of the flange. The seal 20 ensures that no liquid passes through the leadthrough 13 in the flange 11 from the front side to the rear side (wall side) of the flange 11.

The rotary movement of the feed connector 12 relative to the flange 11 is limited by three stop elements 21*a*, 21*b*, 21*c* which—as can be seen in FIG. 6—are formed on the flange 11 and the feed connector 12, to be precise on the hood 18. The stop element 21*a*, which is integrally formed on the hood, moves between the two stop elements 21*b*, 21*c*, which are integrally formed on the flange 11, when the feed connector 12 rotates. In this case, the stop element 21*c* forms a fixing means 35 for the stop element 21*a* in order to define a stop position of the feed connector 12, in which position an external coupling can be completely plugged onto the feed connector 12. In the illustrated exemplary embodiment, the feed connector 12 can rotate between the stop elements 21*b*, 21*c* through approximately 172°.

The connection lines (not illustrated) which lead from the contact elements 17, to which they are connected by means of suitable terminals, to the power supply system in the mobile load also have to follow this rotation of the feed connector 12. In this case, it is necessary to ensure secure and stable contact between the respective connection line and the respective contact element. To this end, a cable strain-relief means 37 is provided on the hood 18, through which cable strain-relief means the connection lines are led from the interior of the hood 18 to the outside. This cable strain-relief means 37 rotates together with the hood 18 and therefore the entire feed connector 12; the connection cables are therefore not exposed to any rotary loads or are exposed to at least virtually no rotary loads in the interior of the hood 18, with the result that there is no risk of the electrical connection breaking off at the contact-connection to the contact pins 17. Rotation of the connection cables through approximately 180° does not constitute a problem for conventional cables outside the hood 18, downstream of the cable strain-relief means 37, and is therefore not problematical.

Figure 7:
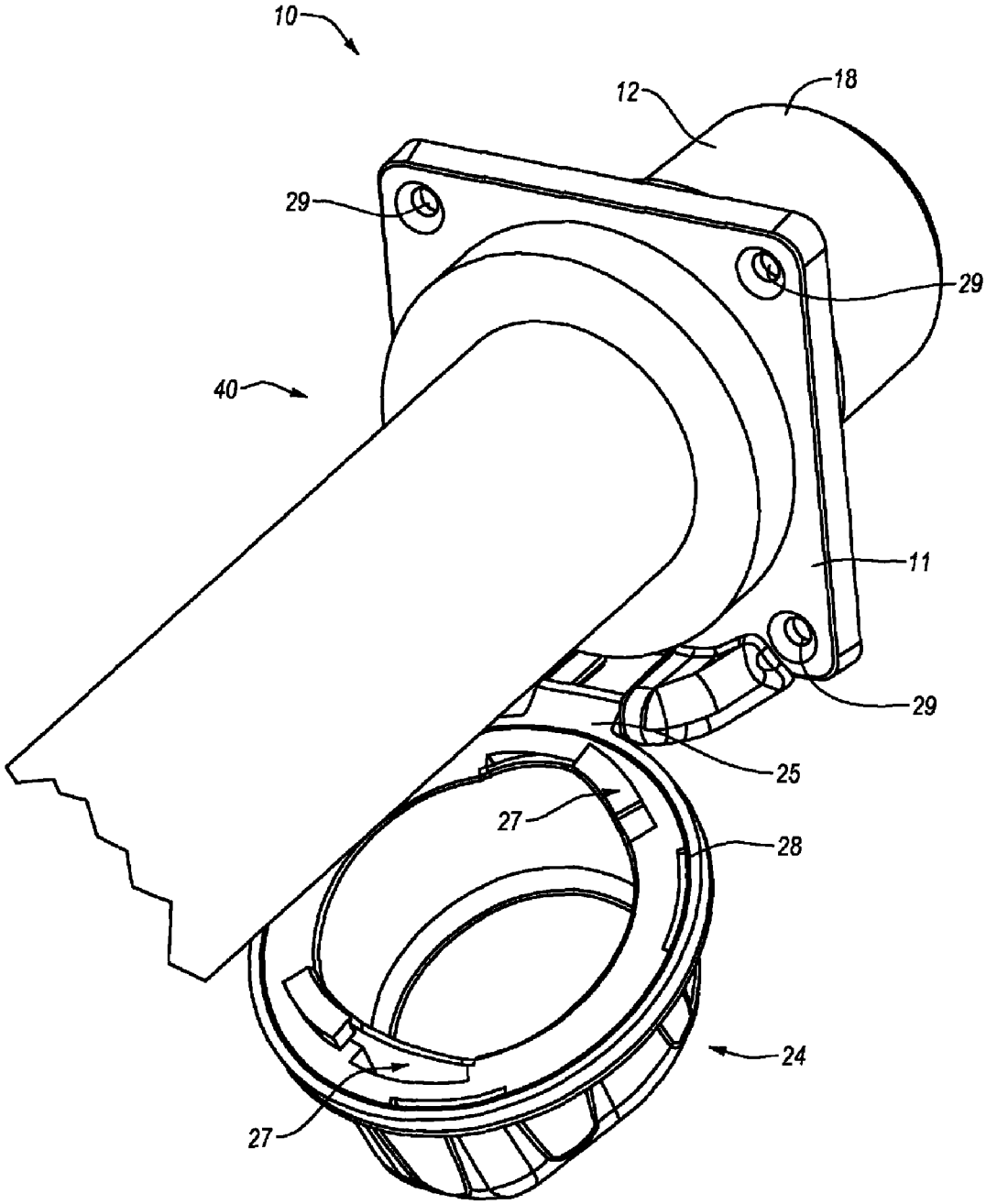
FIG. 7 shows a three-dimensional illustration of one exemplary embodiment of an electrical feed with a coupling inserted therein according to the invention.

An outer bayonet fitting part 22 is formed on the flange 11 at its front side (the side of the flange 11 which faces away from the wall in the installed state). The purpose of this outer bayonet fitting part 22 is to interact with an inner bayonet fitting part 41 (see FIG. 5), which is formed on a coupling 40 with which contact is to be made, in such a way that the outer bayonet fitting part 22 and the inner bayonet fitting part 41 form a bayonet fitting which allows the coupling 40 to be attached to the electrical feed 10 such that it is secured against being accidentally withdrawn. The outer bayonet fitting part 22 comprises two projections 23 which are integrally formed on the flange 11 and protrude inward radially with respect to the axis of rotation A at the edge of the leadthrough 13. The two projections 23 are offset through 180° in relation to one another. This arrangement of the projections 23 and their shape and their dimensions correspond to an inner bayonet fitting element 41 on the coupling 40 with which contact is to be made, to be precise to two recesses 42 in a protruding portion 43 of the coupling 40 which is directed radially outward. When the contact pins 17 of the feed connector 12 are inserted (axially with respect to the axis of rotation A) into corresponding contact elements (contact bushings) of the coupling 40, the projections 23 on the flange 11 pass—if the feed connector 12 is in the above-described stop position (it is only possible to completely insert the coupling in this position)—through the respective corresponding recesses in the protruding portion of the coupling 40 (if the feed connector 12 is not in the stop position, the protruding portion prevents the coupling 40 from being completely inserted; the bayonet fitting cannot be closed). In the case of a subsequent common rotary movement of the coupling 40 and the feed connector 12 relative to the flange 11, the projections 23 pass behind the protruding portion of the inner bayonet fitting part on the coupling. In this position, the projections 23 and the protruding portion prevent the coupling 40 from being withdrawn or removed from the feed connector 12. This is possible only after a corresponding rotary movement of the coupling 40 and the feed connector 12 in the opposite direction with respect to the flange 11. The coupling 40 is therefore effectively prevented from being accidentally removed. The electrical contact region between the coupling 40 and the feed connector 12 is sealed off toward the outside by means of a coupling seal 38 which is arranged in the feed 10 in the form of a ring about the contact carrier 16 of the feed connector 12 when the coupling 40 is completely inserted (see FIG. 7).

The main difference compared to attaching the coupling in conventional feeds is therefore that, in order to close the bayonet fitting, the coupling which is already plugged onto the feed connector 12 is rotated together with the feed connector 12, that is to say the inner bayonet fitting part on the coupling and not an outer bayonet fitting part is rotated, said outer bayonet fitting part being integrated in an additional ring element which surrounds the feed connector in a rotatable manner. In contrast, the outer bayonet fitting part 22, which is formed on the flange, is stationary in the case of the feed 10 according to the invention.

The Figures also show that the feed comprises a cover 24. Said cover is attached to the flange 11 by means of a hinge 25 in a pivotable manner. The leadthrough 13 in the flange 11, including the feed connector 12 which is arranged therein, can be closed by this cover 24. A cover seal 26 is provided for sealing purposes, said cover seal being arranged between the cover 24 and the flange 11 and surrounding the recess 13 in the form of a ring when the cover 24 is closed. FIG. 1 shows that an inner bayonet fitting part 27 is formed in the cover 24, said inner bayonet fitting part corresponding to the outer bayonet fitting part 22 on the flange. These two bayonet fitting parts 22, 27 also form a bayonet fitting. This bayonet fitting can be closed by rotating the cover 24 relative to the flange 11 about the axis of rotation A. The design of the hinge 25 which is provided enables this rotary movement of the cover 24. Said hinge has a ring-like section 28 which is plugged onto the cover 24 in an interlocking but rotatable manner. The cover 24 can be rotated with respect to this ring-like section 28 and therefore with respect to the hinge 25 overall.

LIST OF REFERENCE SYMBOLS

10 Electrical feed, CEE feed
11 Flange
12 Feed connector
13 Leadthrough of the flange 11 for the feed connector 12
14 Front guide face
15 Rear guide face
16 Contact carrier
17 Contact elements, contact pins
18 Hood (housing, covering, pot)
19 Fastening means, screws
20 Seal
21*a,b,c* Stop elements
22 Outer bayonet fitting part
23 Projection
24 Cover
25 Hinge
26 Cover seal
27 Inner bayonet fitting part
28 Ring-like section of the hinge 25
29 Leadthrough for fastening screws
30 Collar
31 Cylinder jacket-like subregion
32 Cylinder jacket-like subregion
33 Protruding portion on the flange 11
34 Protruding portion on the hood 18
35 Fixing means
36 Flange seal
37 Cable strain-relief means
38 Coupling seal
A Center axis, axis of rotation
X Region

We claim:

1. An electrical feed for the external supply of electrical power to a power supply system of a mobile load, in particular a motor home or a recreational vehicle or a boat, comprising:

a) a flange for attaching the electrical feed to a wall or in a wall of the mobile load, wherein the flange forms an outer bayonet fitting part;

b) the electrical feed being configured to be attached to a coupling having an inner bayonet fitting part that corresponds to the outer bayonet fitting part; and c) at least one feed connector arranged in the flange in a rotatable manner and configured for making electrical contact with the coupling, wherein:

d) the feed connector and coupling are configured to jointly rotate when making electrical contact causing the inner bayonet fitting part on the coupling to interface with the outer bayonet fitting part of the flange such that the coupling is secured against being accidentally withdrawn from the feed connector;

e) a pivotable cover is attached to the flange by means of a hinge, the pivotable cover can cover a leadthrough in the flange, and the feed connector which is arranged therein, and the pivotable cover can be closed such that the leadthrough is closed; and f) another inner bayonet fitting part is provided or formed in or on the pivotable cover, the another inner bayonet fitting part corresponding to the outer bayonet fitting part on the flange, it being possible to rotate the cover with respect to the hinge, the hinge arranged between the pivotable cover and the flange, in order to permit the pivotable cover to close over the feed connector and lock to the outer bayonet fitting when the coupling is removed.

2. The electrical feed as claimed in claim 1, wherein the feed connector is arranged or fitted in or at the leadthrough of the flange in the rotatable manner.

3. The electrical feed as claimed in claim 2, wherein the leadthrough has, at least in sections, the shape of a cylinder, and the feed connector can be rotated about a center axis of the cylinder.

4. The electrical feed as claimed in claim 2, wherein the feed connector has, at least in a region that is associated with the leadthrough of the flange, an external shape which corresponds to the leadthrough, in particular a shape of a cylinder jacket.

5. The electrical feed as claimed in claim 3, wherein an axial mobility of the feed connector relative to the flange is limited by at least one front guide face, the front guide face provided on the feed connector, and by at least one rear guide face, the rear guide face arranged opposite the front guide face and is likewise provided on the feed connector, with the front guide face and the rear guide face being formed in such a way that the front guide face and the rear guide face enclose the flange, at least in an edge region around the leadthrough.

6. The electrical feed as claimed in claim 5, wherein the axial mobility of the feed connector relative to the flange is completely or at least largely suppressed by the front guide face and the rear guide face.

7. The electrical feed as claimed in claim 5, wherein the feed connector comprises a contact carrier, in which contact elements are arranged, and a hood, with the contact carrier and the hood being connected to one another by fastening means, with the front guide face being provided or formed on the contact carrier, and the rear guide face being provided or formed on the hood.

8. The electrical feed as claimed in claim 1, wherein at least one seal is arranged between the flange and the feed connector.

9. The electrical feed as claimed in claim 8, wherein the seal or the seals is/are arranged between a front guide face and the flange or between a rear guide face and the flange.

10. The electrical feed as claimed in claim 8, wherein the seal or the seals is/are arranged between a region of the feed connector, the region of the feed connector associated with the leadthrough of the flange and an edge of the leadthrough in the flange.

11. The electrical feed as claimed in claim 1, wherein the rotatable manner of the feed connector relative to the flange is limited.

12. The electrical feed as claimed in claim 11, wherein stop elements are provided or formed on the flange and the feed connector in order to limit the rotatable manner.

13. The electrical feed as claimed in claim 11, wherein the rotatable manner is limited to a maximum rotation angle of between 30° and 270°.

14. The electrical feed as claimed in claim 1, wherein, in order to form the outer bayonet fitting part, at least one projection is provided or formed on the flange, said projection being arranged in such a way that the projection passes through a corresponding recess in a protruding portion of the coupling when the coupling is completely plugged onto the feed connector, and pass behind the protruding portion of the inner bayonet fitting part on the coupling given a subsequent common rotary movement of the coupling and the feed connector, and in this position prevent the coupling from being drawn back away from the feed connector.

15. The electrical feed as claimed in claim 14, wherein the projections of the outer bayonet fitting part of the flange and the contact elements of the feed connector are arranged in such a way that the coupling can be completely plugged onto the electrical feed only in one of two stop positions of the feed connector relative to the flange.

16. The electrical feed as claimed in claim 1, wherein the pivotable cover can cover the leadthrough in the flange, including the feed connector which is arranged therein, such that the leadthrough can be closed, in particular tightly closed by means of a seal.

17. The electrical feed as claimed in claim 16, wherein the hinge has a ring-like section which can be attached to, in particular plugged onto, the cover in an interlocking or force-fitting manner in such a way that the ring-like section is rotatably connected to the cover in the ring direction.

18. The electrical feed as claimed in claim 13, wherein the rotatable manner is limited to a maximum rotation angle of between 160° and 180°.

19. The electrical feed as claimed in claim 18, wherein the rotatable manner is limited to a maximum rotation angle of approximately 172°.

20. The electrical feed as claimed in claim 1, wherein the electrical feed is a CEE feed.

* * * * *